US009895620B1

(12) United States Patent
Walterscheid

(10) Patent No.: US 9,895,620 B1
(45) Date of Patent: Feb. 20, 2018

(54) HAND SPINNER NOVELTY WITH INTEGRATED LIGHTS

(71) Applicant: FSD, LLC, Bend, OR (US)

(72) Inventor: Steven Edward Walterscheid, Bend, OR (US)

(73) Assignee: FSD, LLC, Bend, OR (US)

( * ) Notice: Subject to any disclaimer, the term of this patent is extended or adjusted under 35 U.S.C. 154(b) by 0 days.

(21) Appl. No.: 15/353,089

(22) Filed: Nov. 16, 2016

(51) Int. Cl.
*A63H 1/00* (2006.01)
*A63H 1/24* (2006.01)
*A63H 33/26* (2006.01)

(52) U.S. Cl.
CPC ..... *A63H 1/24* (2013.01); *A63H 1/00* (2013.01); *A63H 33/26* (2013.01)

(58) Field of Classification Search
CPC . A63H 1/00; A63H 1/24; A63H 33/22; A63H 33/26; A63H 33/40
See application file for complete search history.

(56) References Cited

U.S. PATENT DOCUMENTS 2,533,110 A * 12/1950 Harbert ..... F03D 1/0658 116/DIG. 6
3,037,322 A * 6/1962 Baumgartner, Jr. ... A63H 33/00 362/35
5,190,491 A * 3/1993 Connelly ..... A63H 33/26 446/236
6,265,984 B1 7/2001 Molinaroli
6,530,816 B1 * 3/2003 Chiu ..... A63H 33/40 446/217
6,575,585 B2 6/2003 Nelson et al.
6,589,094 B2 * 7/2003 Spencer ..... A63H 33/006 362/35
7,179,149 B2 * 2/2007 Chernick ..... A63H 33/22 417/234
7,361,074 B1 * 4/2008 Periman ..... A63H 5/00 362/192
7,766,718 B2 * 8/2010 Rago ..... A63H 1/24 446/242
8,348,712 B2 * 1/2013 De La Torre ..... A63H 27/12 446/175

* cited by examiner

*Primary Examiner* — John Ricci
(74) *Attorney, Agent, or Firm* — LaMorte & Associates, P.C.

(57) ABSTRACT

A spinner assembly that is spun by a user's hand. The spinner assembly has a central roller bearing. The roller bearing has an inner race and an outer race that are capable of rotating relative each other about a common center of rotation. An annular hub is coupled to the outer race. The annular hub rotates with the outer race. A first spin arm extends from the annular hub and rotates with the annular hub. A second spin arm extends from the annular hub and rotates with the annular hub. A first light module is mounted to the first spin arm that activates as the first spin arm rotates.

18 Claims, 8 Drawing Sheets

HAND SPINNER NOVELTY WITH INTEGRATED LIGHTS

BACKGROUND OF THE INVENTION

1. Field of the Invention

In general, the present invention relates to hand spinners, which are devices that are held in a user's hand and spun. More particularly, the present invention relates to hand spinners that spin about a central stationary hub and contain illuminated features.

2. Prior Art Description

There are many toy novelties that are held in the hand and "spin". Two of the most common toy novelties of this type are toy tops and yo-yos. Although tops and yo-yos spin and are hand powered, they typically do not spin in the user's hand. Rather, they are set spinning by a user's hand and are then released to spin on a flat surface or a string.

Recently, another class of spinning toys has gained popularity. That new class of toys is commonly known as hand spinners. Hand spinners have a roller bearing that is symmetrically set in the middle of a balanced body. The roller bearing is held in a user's fingers as the body of the toy is spun. The result is a toy that appears to be a spinning top that can be held in the hand without affecting the ability of the toy to freely spin.

The present invention improves upon the design of hand spinners by integrating specialized electronics into the spinning elements. In the prior art, electronics have been added to many spinning toys. For example, in U.S. Pat. No. 6,575,585 to Nelson, lights have been incorporated into pinwheels. In U.S. Pat. No. 6,265,984, to Molinaroli, lights have been added to a wide variety of spinning objects such as tops and fans. However, in the prior art, the device that spins always has a solid center. As such, the batteries and electronics needed to run the various lights could be mounted at the center of the spinning device without producing an imbalance in the spinning device. With modern hand spinners, an annular roller bearing is set in the center of the spinning toy. As a result, the center of the spinning toy is an open void. Consequently, there exists no structure at the center of the spinning toy to which an electronic module can be mounted.

A need therefore exists for a technology that enables electronics to be added to a spinning toy at points eccentric to its center in a manner that does not detract from the ability of the toy to spin. This need is met by the present invention as described and claimed below.

SUMMARY OF THE INVENTION

The present invention is a spinner assembly that is spun by a user's hand. The spinner assembly has a central roller bearing. The roller bearing has an inner race and an outer race that are capable of rotating relative each other about a common center of rotation.

An annular hub is coupled to the outer race of the roller bearing. The annular hub rotates with the outer race about the center of rotation. A first spin arm extends from the annular hub and rotates with the annular hub about the center of rotation. The spinner assembly needs only one spin arm to operate. However, subsequent spin arms can be added to the spinner assembly in alternate embodiments. The subsequent spin arm would also extend from the annular hub and rotate with the annular hub about the center of rotation.

A first light module is mounted to the first spin arm. The first light module includes at least one light that activates as the first spin arm rotates about the center of rotation. This creates an aesthetically pleasing effect as the spinner assembly spins. The light can also be activated in a manner synchronized to the speed of rotation to create readable messages or images with the perceived light.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention toy spinner can be embodied in many ways, only a few of exemplary embodiments are illustrated and described. The embodiments selected set forth some of the best modes contemplated for the invention. The illustrated embodiments, however, are merely exemplary and should not be considered limitations when interpreting the scope of the appended claims.

Figure 1:
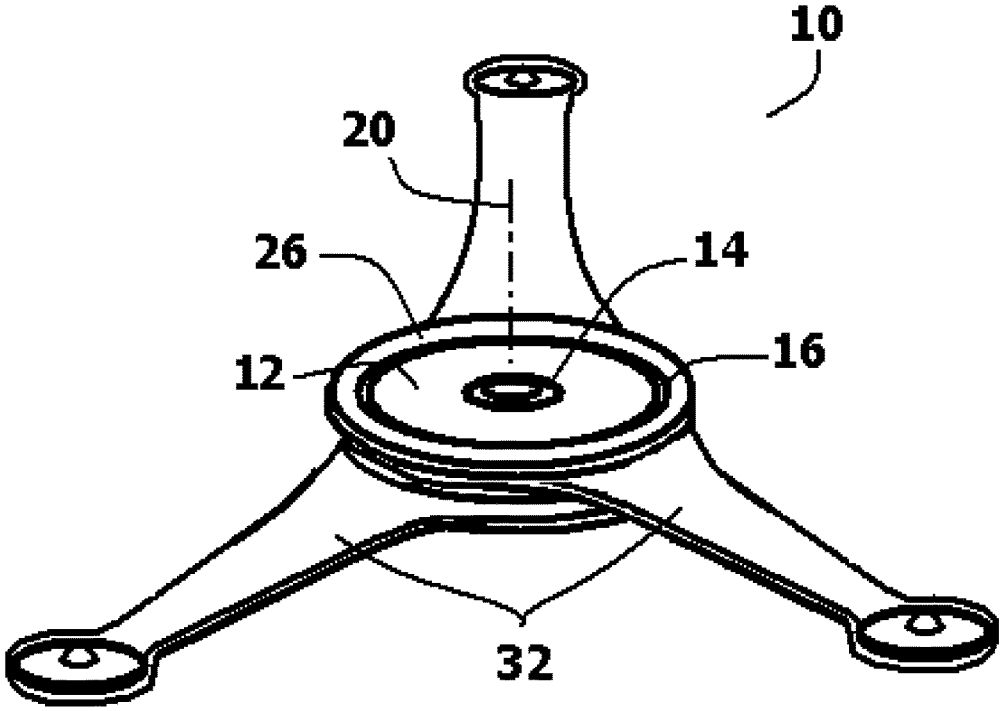
FIG. 1 is a perspective view of an exemplary embodiment of a hand spinner assembly configured with multiple spin arms.
Figure 2:
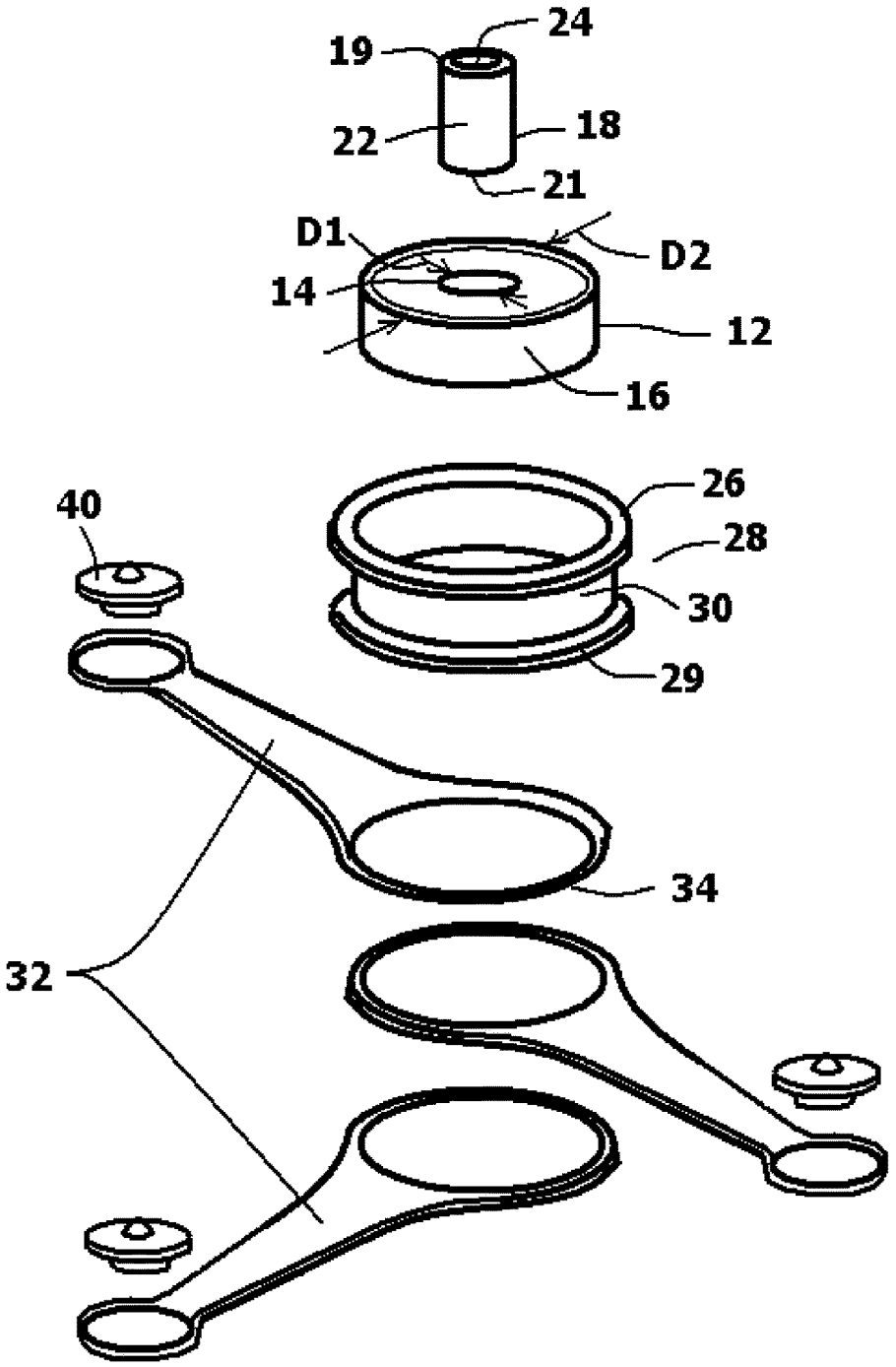
FIG. 2 is an exploded view of the hand spinner assembly of FIG. 1.

Referring to FIG. 1 and FIG. 2, a hand spinner assembly 10 is shown. The hand spinner assembly 10 has a central roller bearing 12. The roller bearing 12 is annular in shape having an inner race 14 of an inner diameter D1 and an outer race 16 of an outer diameter D2. In the center of the inner race is an imaginary center of rotation 20 about which all spinning elements spin. The inner race 14 does not spin about the center of rotation 20. The inner race 14 is held in a stationary position and serves as an axle. Within the roller bearing 12 are ball bearings, or equivalent elements, that enable the outer race 16 to rotate about the inner race 14 in the manner of a traditional roller bearing.

A center support 18 is concentrically set into the inner race 14 of the roller bearing 12. The center support 18 is the structure that is manually held and/or engaged while the hand spinner assembly 10 spins. As will be later explained, the center support 18 can have a variety of different configurations. Regardless of its configuration, it is preferred that the center support 18 engages the inner race 14 of a the roller bearing 12 with a friction fit or some other connection scheme that enables the center support to be selectively removed and replaced by a user when desired.

In the illustrated embodiment, the center support 18 is an elastomeric cylinder 22. The elastomeric cylinder 22 defines a central opening 24 that can receive the end of a pencil or pen with a friction fit. The center support 18 has a top surface 19 and a bottom surface 21 that protrude from the hand spinner assembly 10. In this manner, the hand spinner assembly 10 can be held by pinching opposite ends of the center support 18 between two fingers. This holds the center support 18 and the inner race 14 in a fixed position while the remainder of the hand spinner assembly 10 remains free to spin.

An annular hub 26 is provided that concentrically mounts around the outer race 16. The annular hub 26 can engage the outer race 16 with a friction fit. Adhesive can also be used to ensure the connection between the annular hub 26 and the outer race 16 is secure. The annular hub 26 has a top flange 28, a bottom flange 29, and a cylindrical section 30 between the top flange 28 and the bottom flange 29.

A plurality of spin arms 32 are provided. In the shown embodiment, three spin arms 32 are illustrated. However, it will be understood that one, two, four, or any plurality of spin arms 32 can be present. Each of the spin arms has a looped end 34. The looped end 34 of each spin arm 32 defines a loop opening 36 arm that passes around the cylindrical section 30 of the annular hub 26 and engages the cylindrical section 30 with an interference fit and/or friction fit. This enables each of the spin arms 32 to rotate with the annular hub 26 about the center of rotation 20. The radial position of each spin arm 32 can be selectively changed by a user by moving the spin arm 32 against the bias of the interference and/or frictional fit. On the cylindrical section 30 of the annular hub 26, the looped ends 34 of the spin arms 32 stack atop each other. The spin arms 32 are prevented from moving off the ends of the cylindrical section 30 by the presence of the top flange 28 at one end and the bottom flange 29 at the opposite end.

Figure 3:
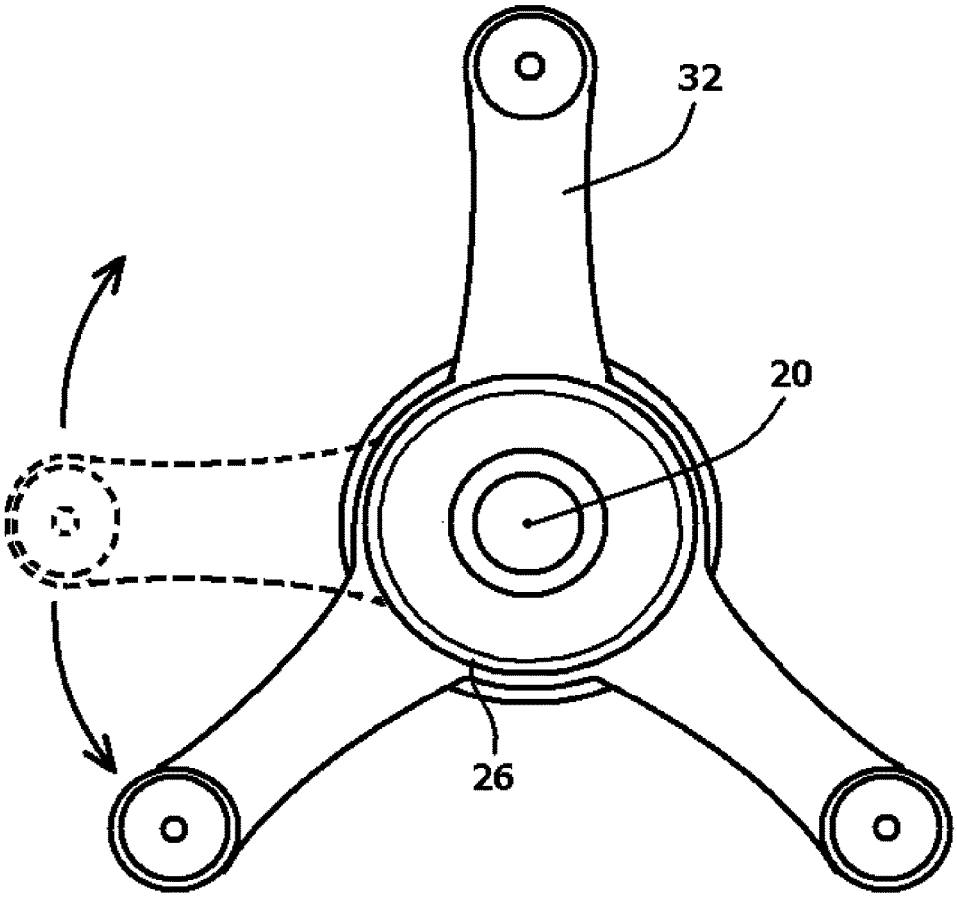
FIG. 3 is a top view of the exemplary embodiment showing the adjustability of the spin arms on the hand spinner assembly.

Each of the spin arms 32 radially extend from the annular hub 26. If more than one spin arm 32 is used, the spin arms 32 are preferably identical or mirror images of one another. In this manner, the spin arms 32 can remain balanced about the center of rotation 20 if symmetrically positioned about the center of rotation 20. However, referring to FIG. 3 in conjunction with FIG. 2, it can be seen that the position of each spin arm 32 can be selectively adjusted on the annular hub 26 to an asymmetric position. When in asymmetric positions, the spin arms 32 are still free to spin with the annular hub 26 about the center of rotation 20. However, the spin arms 32 are unbalanced and will rotate in an erratic manner. By positioning the spin arms 32 to asymmetrical positions, the hand spinner assembly 10 becomes unbalanced, yet easier to spin using rhythmic hand movements.

Figure 4:
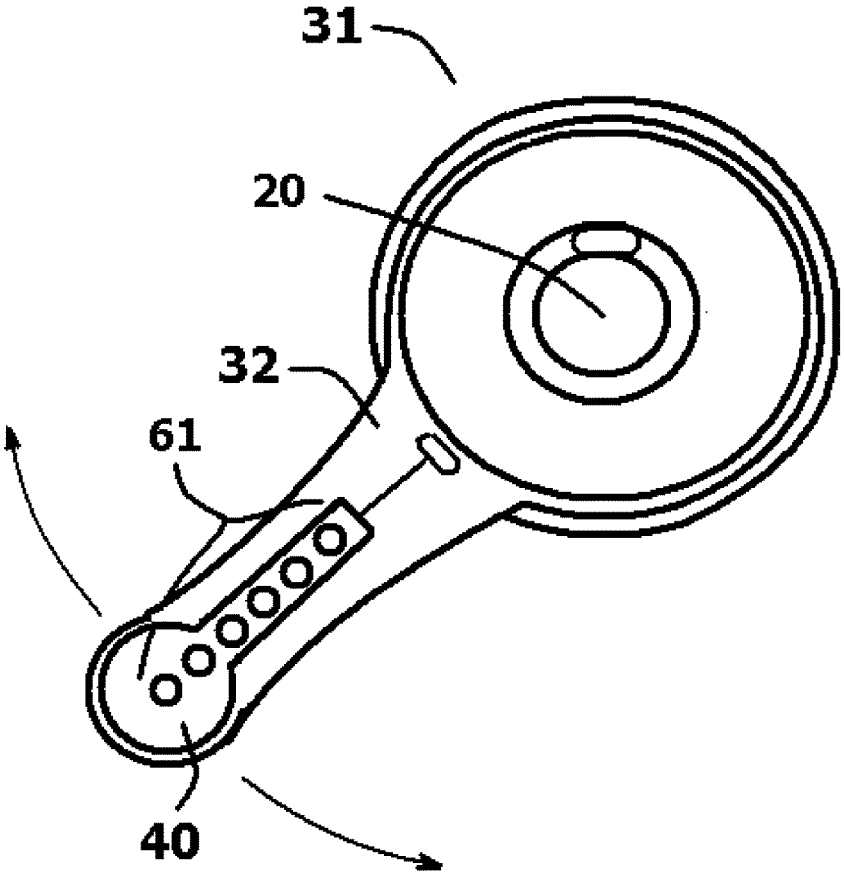
FIG. 4 is a top view of an exemplary embodiment of a hand spinner assembly configured with a single spin arm.

Referring to FIG. 4, an alternate embodiment of a spinner assembly 31 is shown. In this embodiment, the spinner assembly 31 has only one spin arm 32. As such, the spinner assembly 31 is unbalanced. However, the unbalance causes the spinner assembly 31 to have rotational harmonics that enable the spinner assembly 31 to be easily spun using rhythmic hand movements. Like the spinner assembly 10 of FIG. 1 through FIG. 3, the spinner assembly 10 contains an electronic light module 40 that lights as the spin arm 32 spins.

Figure 5:
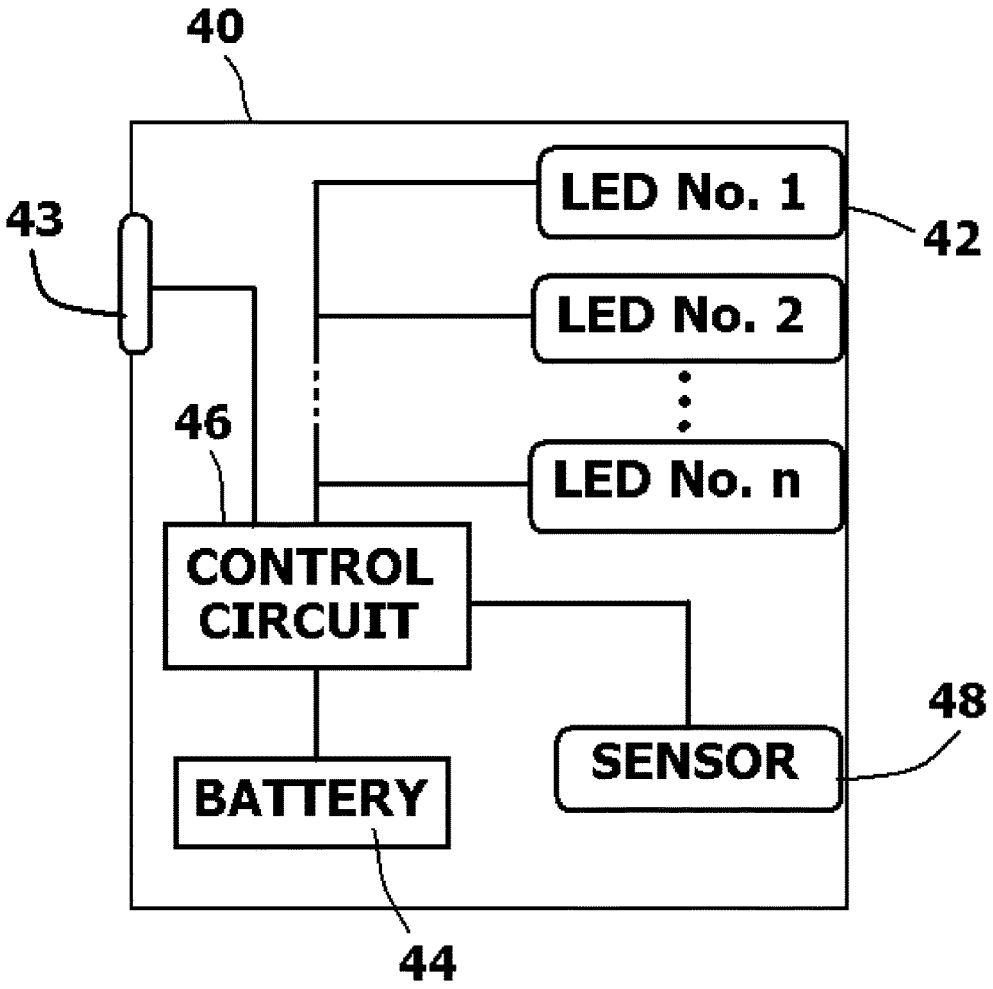
FIG. 5 is a schematic showing the components within an electronic light module.

In all previous embodiments, an electronic light module 40 is provided for at least one spin arm 32. Referring to FIG. 5, it can be seen that an electronic light module 40 is mounted to at least one of the spin arms so that the electronic light module 40 spins with the spin arm. Each electronic light module 40 is a self-contained unit. Each electronic light module 40 contains at least one LED 42, batteries 44 to power the LED 42, and control circuitry 46 for activating the LED 42. The control circuitry 46 is triggered by a sensor 48. In the first exemplary embodiment of the hand spinner assembly 10, the sensor 48 is a motion detector, such as an accelerometer or a tilt switch. As such, the sensor 48 can detect when the spin arms 32 are in motion and can activate and/or deactivate the LED 42 as a function of motion over time.

The electronic module 40 has a user interface 43, in the form of a selection button or a micro switch, which can be used to change the flashing mode of the LEDs 42. As such, the LEDs 42 can be altered to create different light patterns, images, and/or words as the electronic light module spins.

The electronic light modules 40 is preferably mounted to a spin arm, near the distal end of the spin arm, in order to increase the angular momentum of the spin arm as it rotates about the center of rotation.

Figure 6:
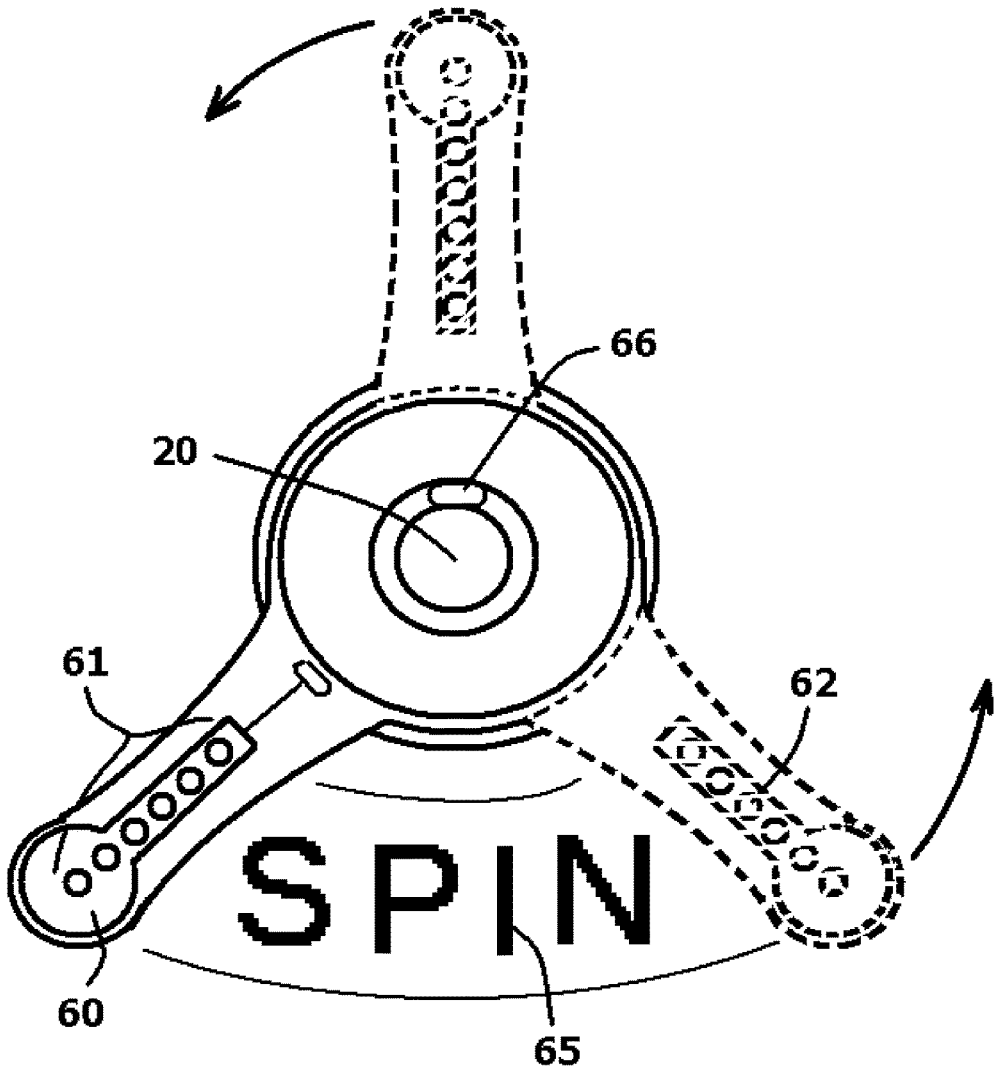
FIG. 6 is a top view of the hand spinner assembly shown creating light paths while spinning.

Referring to FIG. 6, in conjunction with FIG. 5, it will be understood that the electronic light modules 40 light as the spin arms 32 are in motion. As such, the LEDs 42 travel in circular paths 52 about the center of rotation 20. The LEDs 42 from the electronic light modules 40 can rotate in the same path or in slightly different paths. As the LEDs 42 spin, the control circuitry 46 in the various electronic light modules 40 can make the LEDs 42 flash or blink in patterns that are perceived as aesthetically interesting by an observer.

Figure 7:
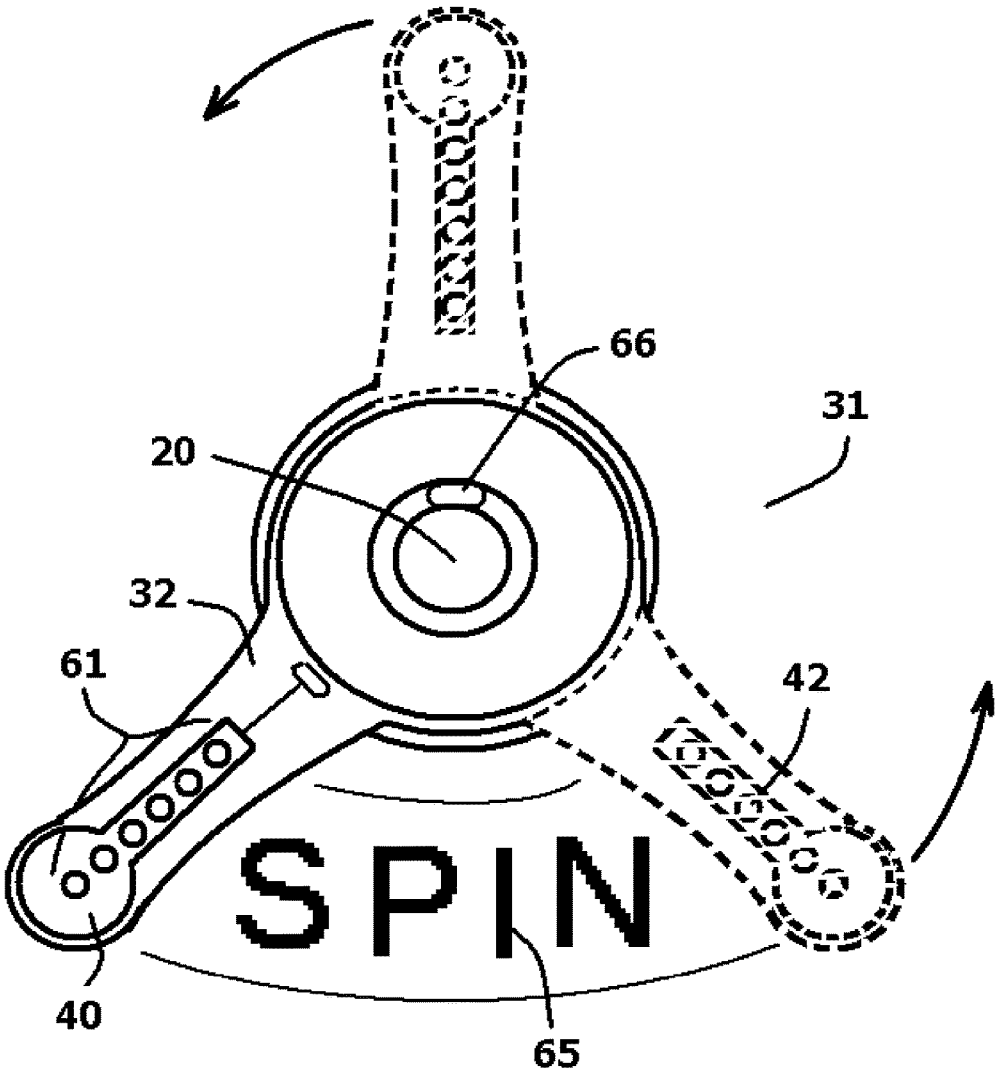
FIG. 7 shows a top view of an alternate embodiment of a hand spinner assembly that contains arrays of lights in each electronic light module.

Referring to FIG. 7, in conjunction with FIG. 5, it can be seen that the electronic light modules 40 can be configured with a linear matrix 61 of LEDs 42. The lighting of the LEDs 42 in the matrix 61 can be controlled so that the LEDs 42 create a readable message 65 or image as the spin arm 32 spins. The pattern, image, or wording created by the matrix 61 can be selectively altered through the user interface 43.

In the embodiment presented in FIG. 4 and FIG. 7, an additional optional control feature is shown. In this embodiment, the spinner assembly 31 uses a magnetic switch, such as a reed switch, as the sensor 48. In this embodiment, at least one magnet 66 is mounted to the inside race 14 of the roller bearing 12. As the spin arm 32 spins, the sensor 48 passes the magnet 66. This activates the sensor 48 and the electronic light module 60. By using a magnet and magnetic switch, the control circuitry 46 in the electronic light module 60 can accurately determine its rotational speed about the center of rotation 20. In this manner, the control circuitry 46 can activate and deactivate the various LEDs 42 to create words and images 65 regardless of the rotational speed of the spin arms 32.

Returning to FIG. 1 and FIG. 2, it will be understood that the center support 18 of the hand spinner assembly 10 is grasped when the hand spinner assembly 10 spins. The center support 18 and the inner race 14 of the roller bearing 12 remain stationary as the remainder of the hand spinner assembly 10 spins. In the embodiment of FIG. 1, the center support 18 is tubular in shape. As such, the center support 18 defines a central opening 24. This enables a pencil, pen, or stick to be inserted into the central opening 24 so that the hand spinner assembly 10 can be spun as a pinwheel.

Figure 8:
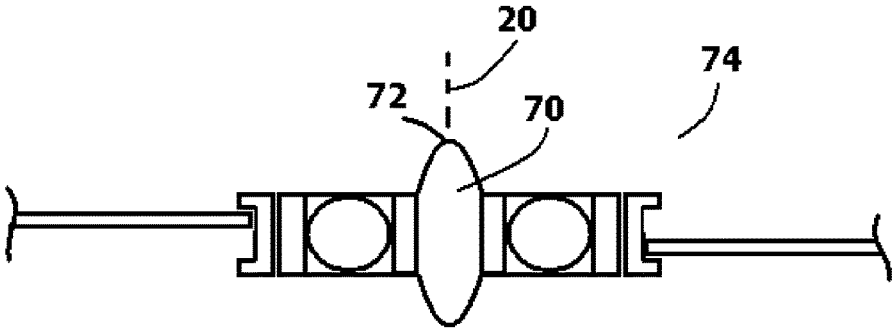
FIG. 8 is a fragmented cross-sectional view of a hand spinner assembly that shows an alternate central support.

Referring to FIG. 8, an alternate embodiment of the center support 70 is provided that is solid and has salient points 72 that are aligned with the center of rotation 20. This enables the hand spinner assembly 74 to be placed on a flat surface and spun as a top, wherein the hand spinner assembly 74 balances on one of the salient points 72.

Figure 9:
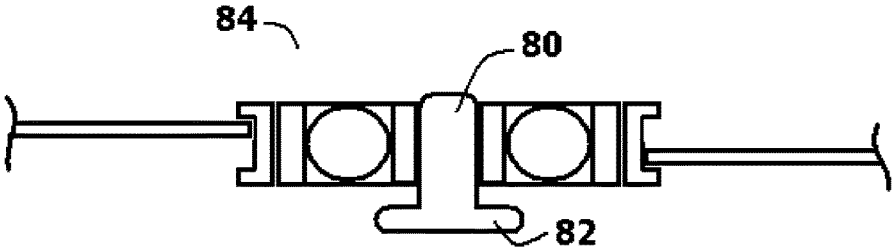
FIG. 9 is a fragmented cross-sectional view of a hand spinner assembly that shows a second alternate central support.

Referring to FIG. 9, an alternate embodiment of the center support 80 is provided that is solid and has a wide base 82. The wide base 82 is magnetized. This enables the hand spinner assembly 84 to be attached to a ferrous metal surface, such as the frame of a car or a bicycle.

It will be understood that the embodiments of the present invention that are illustrated and described are merely exemplary and that a person skilled in the art can make many variations to those embodiments. For instance, the spin arms can be shaped into a variety of designs and lengths. All such embodiments are intended to be included within the scope of the present invention as defined by the claims.

What is claimed is:

1. A spinner assembly, comprising:

a roller bearing having an inner race and an outer race that are capable of rotating relative each other about a center of rotation;

an annular hub coupled to said outer race of said roller bearing, wherein said annular hub rotates with said outer race about said center of rotation;

a first spin arm that extends from said annular hub and rotates with said annular hub about said center of rotation, wherein said first spin arm is adjustable on said annular hub by being selectively rotatable about said annular hub relative said outer race; and a first light module mounted to said first spin arm, wherein said first light module includes at least one light that activates as said first spin arm rotates about said center of rotation.

2. The assembly according to claim 1, further including a second spin arm that extends from said annular hub and rotates with said annular hub about said center of rotation.

3. The assembly according to claim 2, further including a second light module mounted to said second spin arm, wherein said second light module includes at least one light that activates as said second spin arm rotates about said center of rotation.

4. The assembly according to claim 1, wherein said first spin arm engages said annular hub with a friction fit that can be overcome by manual manipulation.

5. The assembly according to claim 1, wherein said light module contains a control circuit that selectively controls said at least one light.

6. The assembly according to claim 5, wherein said control circuit contains a sensor and said control circuit controls said at least one light as a function of conditions detected by said sensor.

7. The assembly according to claim 6, wherein said sensor is selected from a group consisting of motion sensors and magnetic field detectors.

8. The assembly according to claim 1, wherein said at least one light in said light module includes a matrix of lights.

9. The assembly according to claim 1, further including a center support that is engaged with said inner race of said roller bearing and moves with said inner race about said center of rotation.

10. The assembly according to claim 9, wherein said center support is hollow.

11. The assembly according to claim 9, wherein said center support includes a magnet.

12. The assembly according to claim 9, wherein said center support has two opposing ends that extend out of said inner race and terminate with salient points.

13. A spinner assembly, comprising:

a roller bearing having an inner race and an outer race that are capable of rotating relative each other about a center of rotation;

a center support disposed within said inner race;

at least one spin arm that radially extends from said outer race, wherein said at least one spin arm is selectively adjustable in position relative said outer race about said center of rotation; and light modules mounted on said at least one spin arm that lights as said at least one spin arm rotates about said center or rotation.

14. The assembly according to claim 13, further including a hub that is disposed about said outer race of said roller bearing, wherein said at least one spin arm engages said hub with a friction fit.

15. The assembly according to claim 14, wherein said at least one spin arm has a loop opening at one end into which said hub passes.

16. A spinner assembly, comprising:

a roller bearing having an inner race and an outer race that are capable of rotating relative each other about a center of rotation;

an annular hub coupled to said outer race of said roller bearing, wherein said annular hub rotates with said outer race about said center of rotation; and a first spin arm that extends from said annular hub and rotates with said annular hub about said center of rotation, wherein said first spin arm is adjustable on said annular hub by being selectively rotatable about said annular hub relative said outer race.

17. A spinner assembly, comprising:

a roller bearing having an inner race and an outer race that are capable of rotating relative each other about a center of rotation;

an annular hub coupled to said outer race of said roller bearing, wherein said annular hub rotates with said outer race about said center of rotation;

a first spin arm that extends from said annular hub and rotates with said annular hub about said center of rotation; and a center support that is engaged with said inner race of said roller bearing and moves with said inner race about said center of rotation, wherein said center support includes a magnet.

18. A spinner assembly, comprising:

a roller bearing having an inner race and an outer race that are capable of rotating relative each other about a center of rotation;

an annular hub coupled to said outer race of said roller bearing, wherein said annular hub rotates with said outer race about said center of rotation;

a first spin arm that extends from said annular hub and rotates with said annular hub about said center of rotation; and a center support that is engaged with said inner race of said roller bearing and moves with said inner race about said center of rotation, wherein said center support has two opposing ends that extend out of said inner race and terminate with salient points.

* * * * *